US006959457B2

(12) United States Patent
Hernandez

(10) Patent No.: US 6,959,457 B2
(45) Date of Patent: Nov. 1, 2005

(54) ROOF VENT INGRESS PREVENTION DEVICE

(76) Inventor: Andre Hernandez, 2848 Sumner, Lincoln, NE (US) 68502

( * ) Notice: Subject to any disclaimer, the term of this patent is extended or adjusted under 35 U.S.C. 154(b) by 0 days.

(21) Appl. No.: 10/322,063

(22) Filed: Dec. 17, 2002

(65) Prior Publication Data

US 2003/0110554 A1 Jun. 19, 2003

Related U.S. Application Data

(60) Provisional application No. 60/341,310, filed on Dec. 17, 2001.

(51) Int. Cl.[7] ..... E03F 5/08
(52) U.S. Cl. ..... 4/218; 454/4
(58) Field of Search ..... 4/218, 219, 292; 210/463, 497.01, 497.03; 454/4, 367

(56) References Cited

U.S. PATENT DOCUMENTS 380,873 A * 4/1888 Drendul ..... 210/463
421,098 A * 2/1890 Harrington ..... 454/4
511,388 A * 12/1893 White ..... 210/463
770,019 A * 9/1904 Neireiter ..... 210/497.01 X
809,667 A * 1/1906 Breen ..... 4/219 X
902,289 A * 10/1908 Gribben et al. ..... 4/219 X
1,811,728 A * 6/1931 McKee ..... 210/463
2,807,368 A * 9/1957 Blau ..... 210/463
3,392,844 A * 7/1968 Decarie ..... 210/463

* cited by examiner

*Primary Examiner*—Robert M. Fetsuga
(74) *Attorney, Agent, or Firm*—Adam H. Jacobs

(57) ABSTRACT

A roof vent ingress prevention device includes a generally tubular base having a circumferential side wall, a lower pipe-engaging section and an upper section having at least two side vents formed therein, the side vents extending through the side wall for venting of gas from within the generally tubular base. A base slippage prevention device such as a circumferential bead or outward slant to the wall means is mounted on an outer face of the circumferential side wall intermediate the lower pipe-engaging section and the upper section of the generally tubular base and is operative to prevent the generally tubular base from slipping downwards into a roof vent on which it is mounted. Finally, a vent cap is mounted on the upper section of the generally tubular base, the vent cap including a plurality of vent openings formed therein for venting of gas from within the generally tubular base.

4 Claims, 6 Drawing Sheets

ROOF VENT INGRESS PREVENTION DEVICE

CROSS-REFERENCE TO RELATED APPLICATION

This application claims priority to the filing date of related patent application Ser. No. 60/341,310 filed Dec. 17, 2001.

BACKGROUND OF THE INVENTION

1. Technical Field

The present invention relates to roof ventilation devices, and, more particularly, to a roof vent ingress prevention device including a generally tubular base member with at least one side vent and a mesh vent cap mounted on and atop the tubular base member that prevents the ingress of foreign objects into the venting system and allows for dissipation of occluded gases.

2. Description of the Prior Art

The majority of household plumbing systems include some sort of vent pipe which extends above the roof of the dwelling to vent sewer gases from the plumbing system. It is important that the vent pipe remain unclogged to properly vent the gases, and it has been found that debris and animals can enter the vent pipe and cause the pipe to become nonfunctional. There are numerous devices found in the prior art which are intended to prevent the entry of animals or debris into the roof vent of a plumbing system. For example, there are several older devices that are intended to perform such functions, including Levy, U.S. Pat. No. 926,704, Harrington, U.S. Pat. No. 421,098 and Breen, U.S. Pat. No. 809,667. Other more recent inventions include Wilkerson, U.S. Pat. No. 4,398,453, Rasksen, U.S. Pat. No. 5,689,928 and Painter, U.S. Pat. No. 3,456,573, each of which are to be fitted onto pipes to prevent ingress of animals and debris into the pipe which might cause the sewer pipe to become clogged and inoperable.

However, each of the devices found in the prior art has inherent deficiencies which do not fully address the problems encountered with vent pipes, as each of the prior art devices still can clog and render the pipe nonfunctional.

Therefore, an object of the present invention is to provide an improved roof vent ingress prevention device.

Another object of the present invention is to provide an improved roof vent ingress prevention device which may be quickly and easily mounted on the roof vent in a generally secure manner to prevent ingress into the roof vent.

Another object of the present invention is to provide an improved roof vent ingress prevention device which includes not only side vents for gas but also top vents for gas to permit adequate venting of gas from the roof vent.

Finally, an object of the present invention is to provide an improved roof vent ingress prevention device which is cost-effective and durable in manufacture and is simple and efficient in use.

SUMMARY OF THE INVENTION

The present invention provides a roof vent ingress prevention device includes a generally tubular base having a circumferential side wall, a lower pipe-engaging section and an upper section having at least two side vents formed therein, the side vents extending through the side wall for venting of gas from within the generally tubular base. A base slippage prevention device such as a circumferential bead or outward slant to the wall means is mounted on an outer face of the circumferential side wall intermediate the lower pipe-engaging section and the upper section of the generally tubular base and is operative to prevent the generally tubular base from slipping downwards into a roof vent on which it is mounted. Finally, a vent cap is mounted on the upper section of the generally tubular base, the vent cap including a plurality of vent openings formed therein for venting of gas from within the generally tubular base.

It is thus seen that the present invention provides a substantial improvement over those inventions found in the prior art. For example, many of the devices found in the prior art address only the issue of ingress prevention or proper ventilation, but do not address and solve both. Furthermore, as the present invention is relatively simple in manufacture and is durable in use, the average homeowner will not have to replace the unit as often as is required by many of the devices found in the prior art. Finally, because the present invention includes both side vents and top holes, it will be a very rare situation indeed in which both of the gas ventilation openings will be covered, and thus the roof vent will never be completely covered by debris or by ingress of animals. The present invention thus provides a substantial improvement over the prior art.

DESCRIPTION OF THE PREFERRED EMBODIMENT

Figure 1:
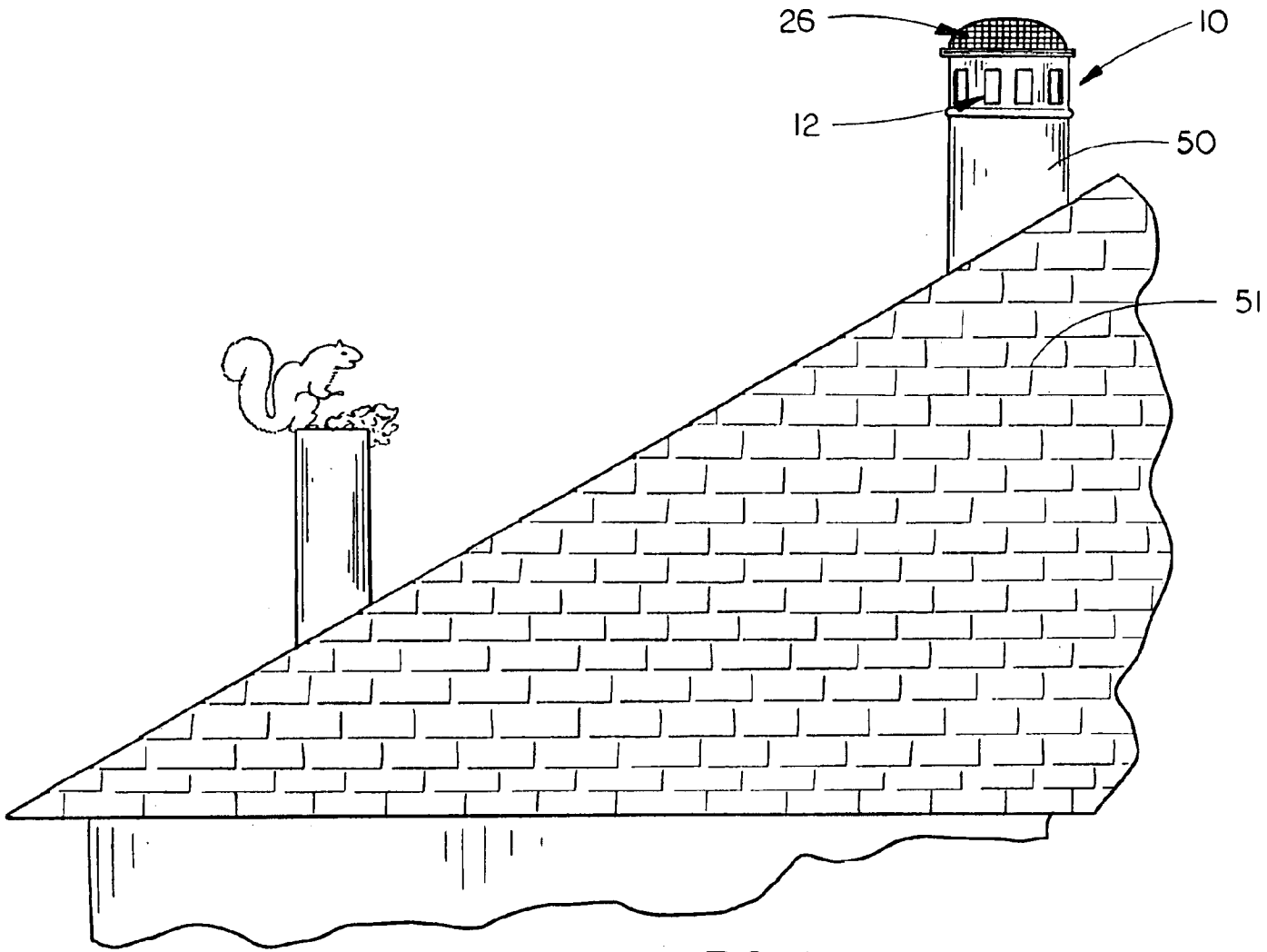
FIG. 1 is an elevational view of a roof and the present invention affixed thereon.
Figure 2:
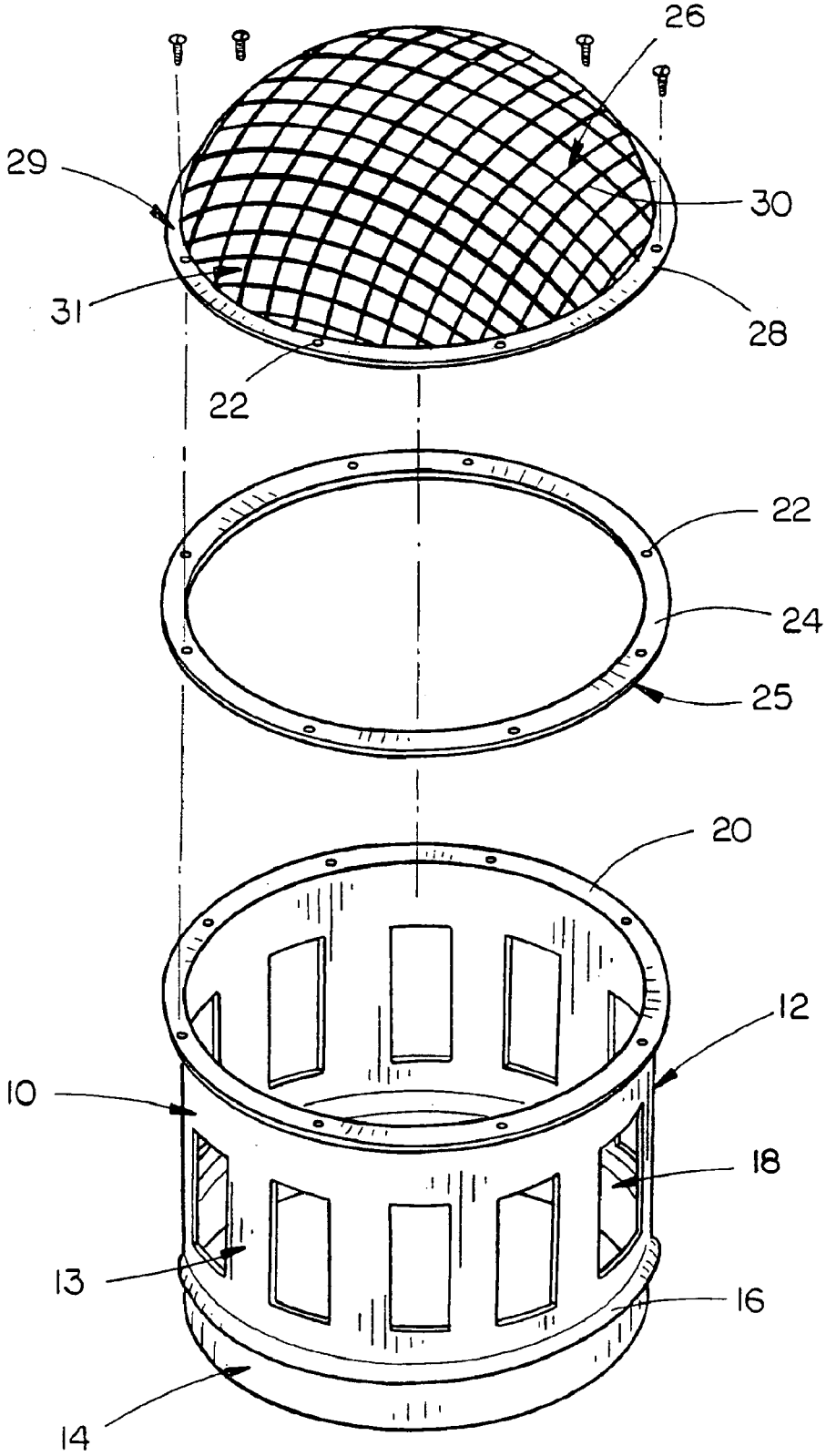
FIG. 2 is an exploded perspective view of the components of the present invention.
Figure 3:
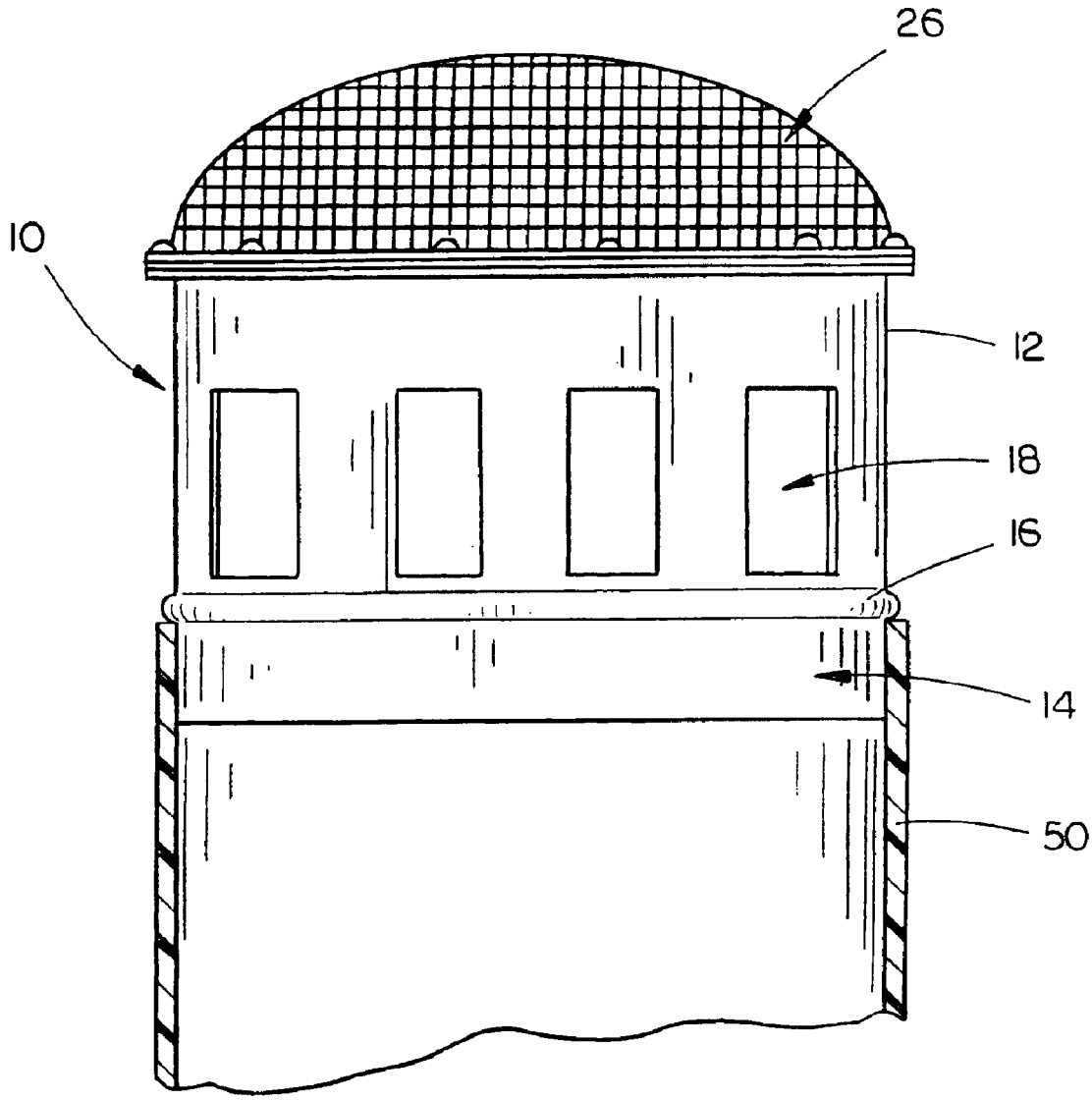
FIG. 3 is a side sectional elevational view of a roof vent pipe and the present invention fitted thereon.

The roof vent ingress prevention device 10 is best shown in FIGS. 1–3 as including a generally tubular base member 12 of approximately one to six inches (1" to 6") in diameter and approximately five to ten inches (5" to 10") in height. The tubular base member 12 would be manufactured of polyvinylchloride ("PVC") in the preferred embodiment and would be generally cylindrical in shape. The lower end of the tubular base member 12 is the pipe engaging section 14 defined by and positioned below the circumferential bead 16. The pipe engaging section 14 of the tubular base member 12 should be of sufficient length to securely fit within the vent pipe 50 and to prevent weather disturbances from dislodging the invention from the vent pipe. The circumferential bead 16 prevents the invention 10 from slipping into the vent pipe 50 and is formed by manufacture molding the PVC thereby creating a circumferential distension or lip extending by approximately one-half inch (½") outwardly from the outer wall 13 18 of the tubular base member 12.

Formed in and extending through the outer wall 13 of the tubular base member 12 and interposed between the circumferential bead 16 and the upper circumferential flange 20 are approximately two (2) to ten (10) side vents 18. The side vents 18 are generally rectangular and should have dimensions of approximately one and one-half inches (1½") in height and approximately one-half inch (½") in width. The preferred embodiment would have the side vents 18 oriented closely enough to the circumferential flange 20 to prevent an occluded gas sink from forming if the mesh vent cap 26 is covered or clogged or in situations of low or no wind.

Above the side vents 18 and positioned on the upper end of the tubular base member 12 is the upper circumferential flange 20. The upper circumferential flange 20 is a rim-like extension protruding circumferentially approximately one-half inch (½") from the outer wall 13 of the tubular base member 12 and has at least one (1) screw hole 22 bored through the flange face which is located on the top portion of the upper circumferential flange 20. The upper circumferential flange 20 is adapted to permit securement of the mesh vent cap 26 to the tubular base member 12 as will be described below.

The mesh vent cap 26 includes a lower o-ring 24 of approximately one and one-half inches (1½") to four inches (4") in diameter and approximately one-fourth inch (¼") thick and one-eighth inch (⅛") wide and has at least one (1) screw hole 22 bored in the lower o-ring face 25. The lower o-ring 24 secures the metal mesh 30 to the upper o-ring 28 thereby creating the mesh vent cap 26. The upper o-ring 28 is located between the metal mesh 30 and the lower o-ring 24 and is approximately the same size and dimensions as the lower o-ring 24 and has at least one (1) screw hole 22 bored through the upper o-ring face 29. The upper o-ring 28 and the o-ring 24 secure the edges of the metal mesh 30 when the invention is assembled.

The metal mesh 30 is a roughly circular portion of reticulated metal mesh and approximately one and one-half inches (1½") to four inches (4") in diameter. The mesh openings 31 are approximately one-half inch (½") by one-half inch (½) in the preferred embodiment and allow for the escape of gas and to prevent ingress of foreign objects into the venting system.

Securement of the of the metal mesh 30 and creation of the mesh vent cap 26 is accomplished by forming the mesh 30 into a general dome-like shape, having a height of approximately one inch (1") at the apex measured from the upper o-ring 28, and sandwiching the edge of the circularly cut metal mesh 30 between the lower o-ring 24 and the upper o-ring 28. The metal mesh 30, upper o-ring 28, and the lower o-ring 24 are placed atop and secured to the upper circumferential flange 20 via the use of a plurality of screws to be threaded and tightened through the screw holes 22 in the flange face, lower o-ring face 25, and the upper o-ring face 29.

As FIG. 1 exemplifies, the vent ingress prevention device 10 is placed in and on a vent pipe 50 atop a roof 51. The pipe engaging end 14 of the tubular base member 12 is inserted within a vent pipe 50 placing the circumferential bead 16 directly atop the vent pipe 50 as best shown in FIG. 3. The gases being vented through the vent pipe enter the roof vent ingress prevention device 10 and are exhausted through the mesh vent cap 26 and the side vents 18. The mesh vent cap 26 prevents the ingress of foreign material into the venting system as best shown in FIG. 1. The side vents 18 have dual function of venting gas under normal operating conditions and venting occluded gases that can build-up if the mesh vent cap 26 is obstructed as seen in prior art.

Figure 4:
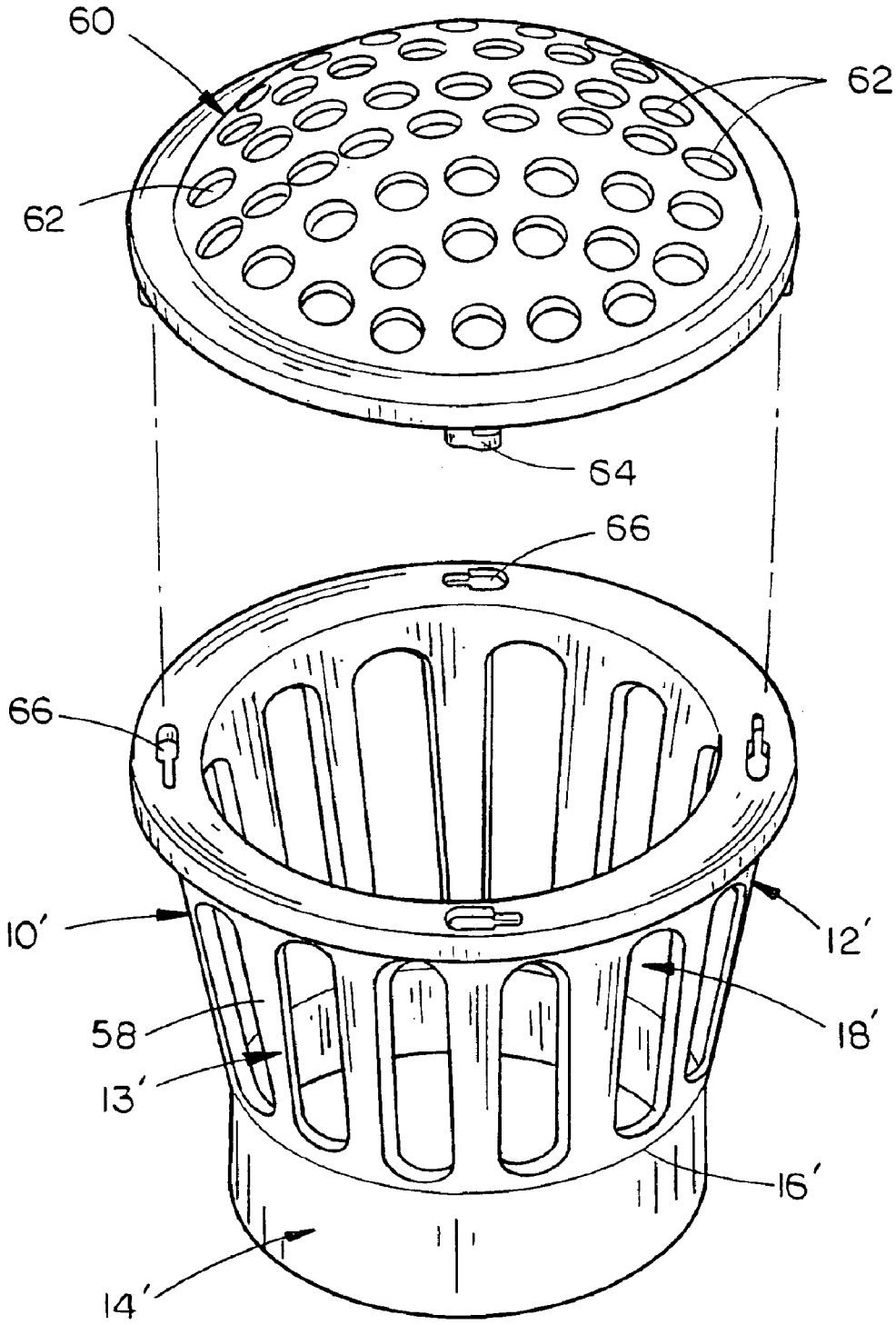
FIG. 4 is a perspective view of a second embodiment of the present invention.
Figure 5:
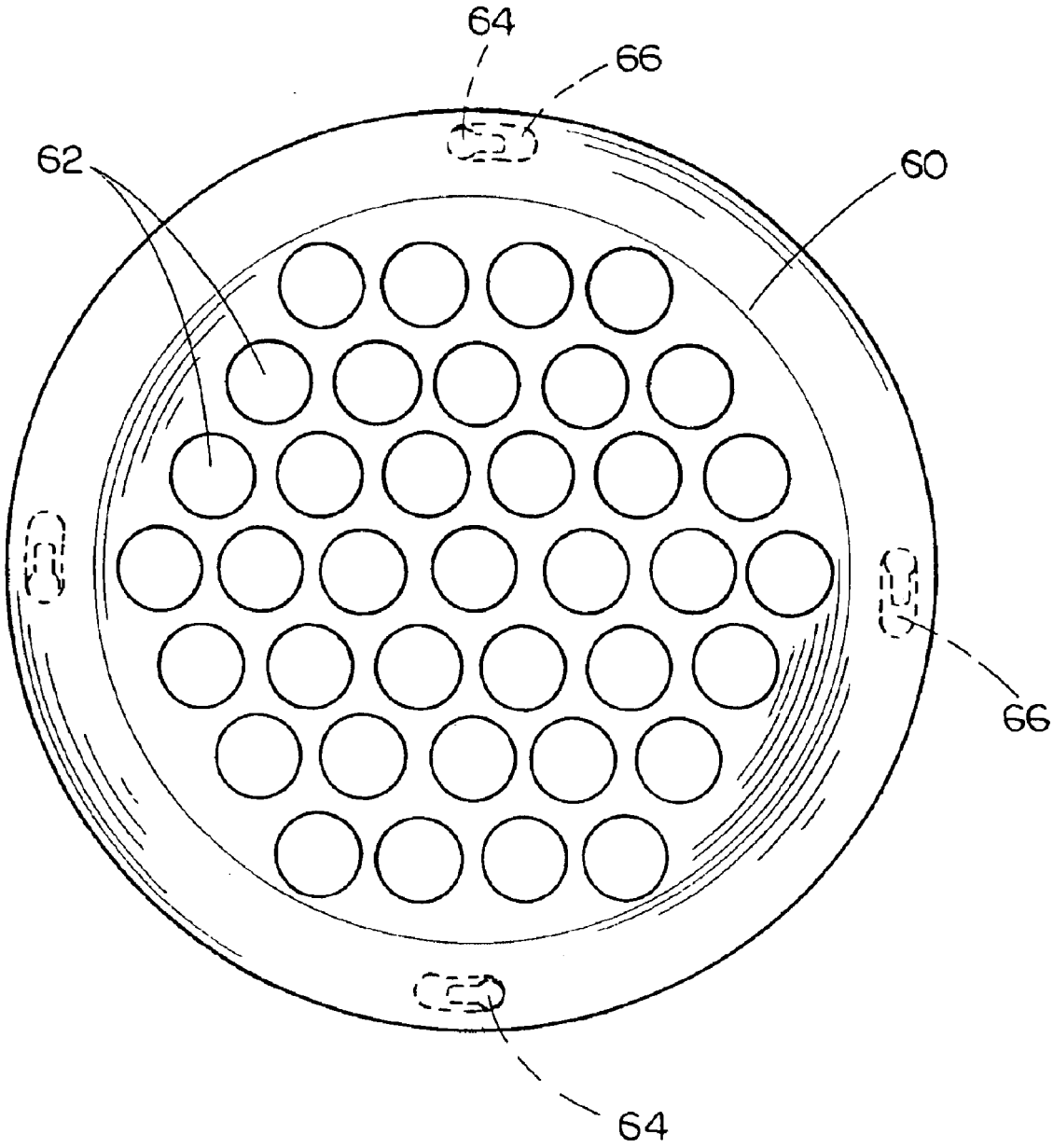
FIG. 5 is a detail top plan view of the second embodiment of the present invention.
Figure 6:
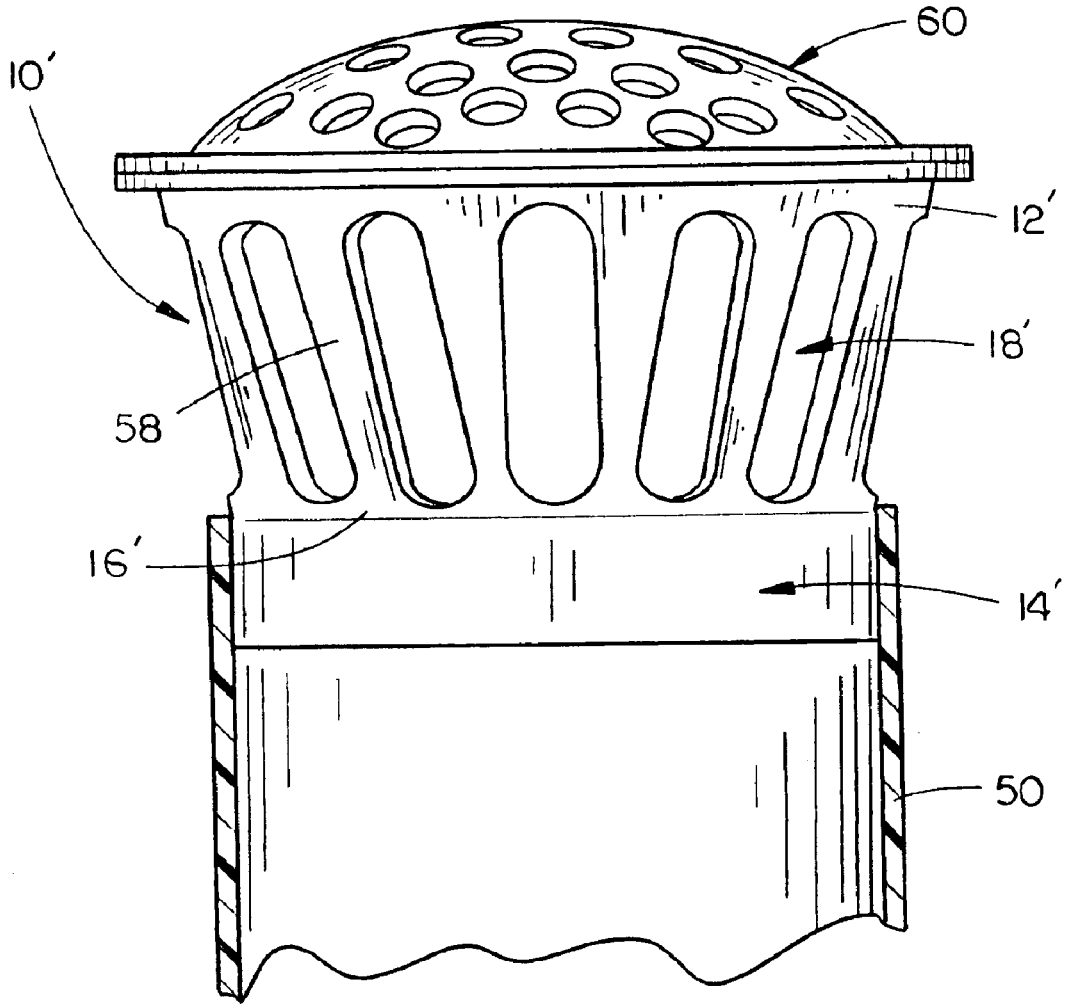
FIG. 6 is a side elevational view of the second embodiment of the present invention.

A second preferred embodiment is shown best in FIGS. 4–7 as including a generally tubular base 12' which includes a lower pipe-engaging section 14' which is generally cylindrical in shape. The upper section 58 of the generally tubular base 12' would be generally conical in shape in that it extends outwards having an upper diameter greater than the lower diameter where the upper section 58 engages lower pipe-engaging section 14', as shown best in FIG. 4. The sidewall 13' of the upper section 58 would include a plurality of side vents 18' formed therein for permitting venting of gas from within the generally tubular base 12'. The inner section of upper section 58 and lower pipe-engaging section 14' forms a circumferential shoulder 16' which serves substantially the same purpose as the circumferential bead 16 as described in connection with the embodiment of FIGS. 1–3. In other words, the circumferential shoulder 16' prevents the roof vent ingress prevention device 10' of the present invention from falling into the roof vent or vent pipe 50, as best shown in FIG. 6. In the preferred embodiment, as shown in FIG. 6, the circumferential shoulder 16' includes an angled portion extending at an angle less than forty-five degrees (45°) from vertical. in order to connect the upper section 58 and lower pipe-engaging section 14'. Of course, any other appropriate type of base slippage prevention device such as a circumferential bead or even retaining clips may be used with the present invention so long as the intended purpose of preventing slippage of the lower pipe-engaging section 14' within the vent pipe 50 is achieved.

Mounted on top of and connected to the upper section 58 is a vent cap 60 which substitutes for the mesh vent cap 26 described in connection with the embodiment of FIGS. 1–3. In the preferred embodiment, the vent cap 60 would be constructed of material similar to that used in construction of the generally tubular base 12', specifically being a PVC-type plastic material or the like, which will ensure that the roof vent ingress prevention device 10' is relatively simple to construct and has increased longevity in use. A plurality of holes 62 are formed in the cap 60, as shown best in FIG. 5, the holes extending through cap 60 and permitting outflow of gases from within the generally tubular base 12'. The diameter of the hole 62 is only critical in preventing ingress of foreign objects and materials into the vent pipe 50, and therefore it is expected that the diameter of each of the vent holes 62 will be approximately one-eighth to one-half of an inch. The exact connection of the cap 60 to the generally tubular base 12' is not critical to the present invention, although it is to be understood that the embodiment shown in FIGS. 4–6 includes the following securement elements.

A plurality of downward extending pins 64 are mounted on and extend downwards from the underside of cap 60 adjacent the perimeter thereof, the pins 64 adapted for insertion into a plurality of keyhole slots 66 formed in the upper circumferential flange 20' of the generally tubular base 12', as shown best in FIGS. 4 and 5. In the preferred embodiment, the keyhole slot 66 would have a larger open end for reception of the ends of pins 64 and a narrower end for retention of pins 64 within each of the keyhole slots 66 upon a rotation of the cap 60 relative to the upper circumferential flange 20'. The cap 60 is thus securely mounted on the generally tubular base 12'. Finally, it should be noted that the precise size and shape of the holes 62 and side vents 18' are not critical to the present invention so long as the dual functions of both preventing ingress of animals and debris and permitting the venting of gases from the vent pipe 50 are maintained.

It is to be understood that numerous modifications, additions, and substitutions may be made to the present invention which fall within the intended broad scope of the above description. For example, the exact size, shape, and construction materials used in the present invention may be modified and/or changed so long as the functionality of the invention is not impaired or degraded. Furthermore, any type of fastening devices used with this present invention may be modified or various other types of fastening devices may be used so long as the fastening function is maintained. Additionally, it is to be noted that the present invention describes a generally tubular base member 12 but it is to be understood that the shapes of pipe vents 50 vary and this invention is intended to include various other forms dependent upon the shape of the pipe vent 50. Also, the mesh vent cap 26, although described as consisting of several distinct parts, could conceivably be manufactured into one piece and placed atop the upper circumferential flange 20 and effectuating the same function. Finally, it should be noted that the second embodiment of the present invention may include numerous changes and modifications, such as in the size and shape of the unit or to the connection of the vent cap to the base, any of which are understood to be part of the present disclosure and may be substituted for the elements described herein.

There has therefore been shown and described an roof vent ingress prevention device 10 which accomplishes at least all of its intended purposes.

I claim:

1. A roof vent ingress prevention device for preventing clogging of a roof vent comprising:

a generally tubular base having a circumferential side wall, a lower pipe-engaging section and an upper section having at least two side vents formed therein, said side vents extending through said side wall for venting of gas from within said generally tubular base;

said upper section of said generally tubular base being generally conical in shape with a top edge having a greater diameter than a lower edge where said upper section contacts said lower pipe-engaging section;

a generally circumferential shoulder formed on an outer face of said circumferential side wall intermediate said lower pipe-engaging section and said upper section of said generally tubular base operative to prevent said generally tubular base from slipping downwards into a roof vent in which it is mounted beyond said lower pipe-engaging section, said shoulder including an angled portion extending at an angle less than forty-five degrees (45°) from vertical, said angled portion extending from and connected to said lower pipe-engaging section; and a vent cap removably mounted on said upper section of said generally tubular base, said vent cap including a plurality of vent openings formed therein for venting of gas from within said generally tubular base.

2. The roof vent ingress prevention device of claim 1 further comprising a plurality of downward extending pins mounted on and extend downwards from the lower side of said vent cap adjacent the perimeter thereof, said pins adapted for insertion into a plurality of keyhole slots formed in an upper circumferential flange of said generally tubular base such that said pins are releasably retained within said keyhole slots upon said vent cap being rotated relative to said generally tubular base.

3. The roof vent ingress prevention device of claim 1 wherein said generally tubular base and said vent cap are constructed of molded PVC plastic.

4. A roof vent ingress prevention device for preventing clogging of a roof vent comprising:

a generally tubular base having a circumferential side wall, a lower pipe-engaging section and an upper section having at least two side vents formed therein, said side vents extending through said side wall for venting of gas from within said generally tubular base;

a generally circumferential shoulder formed on an outer face of said circumferential side wall intermediate said lower pipe-engaging section and said upper section of said generally tubular base operative to prevent said generally tubular base from slipping downwards into a roof vent in which it is mounted beyond said lower pipe-engaging section;

a plurality of downward extending pins mounted on and extend downwards from the lower side of said vent cap adjacent the perimeter thereof, said pins adapted for insertion into a plurality of keyhole slots formed in an upper circumferential flange of said generally tubular base such that said pins are releasably retained within said keyhole slots upon said vent cap being rotated relative to said generally tubular base;

a vent cap removably mounted on said upper section of said generally tubular base, said vent cap including a plurality of vent openings formed therein for venting of gas from within said generally tubular base.

* * * * *